US009498655B2

(12) United States Patent
Paglioli

(10) Patent No.: US 9,498,655 B2
(45) Date of Patent: Nov. 22, 2016

(54) SAFETY AND DESCENDER DEVICE

(75) Inventor: Carlo Paglioli, Cisano Bergamasco (IT)

(73) Assignee: ALUDESIGN S.P.A., Cisano Bergamasco (BG) (IT)

( * ) Notice: Subject to any disclaimer, the term of this patent is extended or adjusted under 35 U.S.C. 154(b) by 90 days.

(21) Appl. No.: 13/996,005

(22) PCT Filed: Jan. 12, 2012

(86) PCT No.: PCT/IB2012/000044

§ 371 (c)(1),
(2), (4) Date: Mar. 11, 2014

(87) PCT Pub. No.: WO2012/095737

PCT Pub. Date: Jul. 19, 2012

(65) Prior Publication Data

US 2014/0174850 A1 Jun. 26, 2014

(30) Foreign Application Priority Data

Jan. 13, 2011 (IT) ..... MI2011A0023

(51) Int. Cl.
*A62B 1/14* (2006.01)
*A63B 29/02* (2006.01)
*A63B 69/00* (2006.01)

(52) U.S. Cl.
CPC ..... *A62B 1/14* (2013.01); *A63B 29/02* (2013.01); *A63B 69/0048* (2013.01)

(58) Field of Classification Search
CPC ..... A62B 1/14; A62B 35/005; A62B 35/0081; A63B 29/02; A63B 29/08; A63B 29/028; A63B 29/024
See application file for complete search history.

(56) References Cited

U.S. PATENT DOCUMENTS

RE33,104 E * 10/1989 Taylor ..... 248/231.85
5,168,958 A * 12/1992 Wullimann ..... 182/236
5,348,116 A * 9/1994 Pickering ..... 182/5
(Continued)

FOREIGN PATENT DOCUMENTS

JP H10-295840 A 11/1998
WO WO 2011/007225 A1 1/2011

*Primary Examiner* — Alvin Chin-Shue
*Assistant Examiner* — Shiref Mekhaeil
(74) *Attorney, Agent, or Firm* — Lucas & Mercanti, LLP

(57) ABSTRACT

It is described a belay, of static or dynamic type, and descender, of self-blocking type and not, device for securing one or more ropes comprising a main body composed of at least two or more flat plates constrained one to another according to planes preferably parallel, or slightly tilted, by a plurality of spacer pins. The rope/s is/are inserted inside the body of the device which further comprises a first karabiner hooked to the main body by passing through an opening in the device body. The karabiner is movable in the opening between an unlocking position of the rope, that is the usual use condition, and an emergency position wherein the rope is blocked, and vice versa. The device further comprises a hole passing through the device body allowing the hooking of the first karabiner removed from the opening or of a second karabiner around which the rope/s is/are passed, and further means for constraining the device body to a fixed hooking point, which comprise at least one through hole inside which a further respective karabiner is hooked.

10 Claims, 8 Drawing Sheets

(56) References Cited

U.S. PATENT DOCUMENTS

| | | | | |
|---|---|---|---|---|
| 5,577,576 | A * | 11/1996 | Petzl et al. | 188/65.4 |
| 6,029,777 | A * | 2/2000 | Rogelja | 182/193 |
| 6,681,891 | B2 * | 1/2004 | Richard et al. | 182/5 |
| 6,732,833 | B2 * | 5/2004 | Rogelja | 182/5 |
| 7,353,910 | B2 * | 4/2008 | Klingler | 182/5 |
| D586,001 | S * | 2/2009 | Petzl | D25/69 |
| 7,658,264 | B2 * | 2/2010 | Mauthner | 182/5 |
| 7,757,812 | B2 * | 7/2010 | Bamberg et al. | 182/5 |
| 7,845,467 | B2 * | 12/2010 | Petzl et al. | 182/5 |
| 8,312,965 | B2 * | 11/2012 | Petzl et al. | 182/5 |
| 8,316,989 | B2 * | 11/2012 | Bamberg et al. | 182/5 |
| D716,132 | S * | 10/2014 | Gobbi | D8/356 |
| 2002/0084139 | A1 | 7/2002 | Richard et al. | |
| 2003/0034203 | A1 * | 2/2003 | Hewlett et al. | 182/5 |
| 2004/0020727 | A1 * | 2/2004 | Petzl et al. | 188/65.1 |
| 2004/0129494 | A1 * | 7/2004 | Cherpitel | 182/5 |
| 2005/0082115 | A1 * | 4/2005 | Petzl et al. | 182/5 |
| 2007/0187176 | A1 * | 8/2007 | Christianson | 182/5 |
| 2008/0245611 | A1 * | 10/2008 | Klingler | 182/6 |
| 2010/0031479 | A1 | 2/2010 | Apicella | |
| 2010/0122873 | A1 * | 5/2010 | Plaze et al. | 182/193 |
| 2011/0042984 | A1 * | 2/2011 | Rocourt et al. | 294/82.33 |
| 2011/0073417 | A1 * | 3/2011 | Chaumontet et al. | 188/65.5 |
| 2011/0114415 | A1 * | 5/2011 | Chu | 182/5 |
| 2011/0258815 | A1 * | 10/2011 | Everette | 24/134 R |
| 2011/0284323 | A1 * | 11/2011 | Ayre | 182/5 |
| 2012/0005864 | A1 * | 1/2012 | Chen | 24/132 WL |
| 2012/0111665 | A1 * | 5/2012 | Paglioli | 182/5 |
| 2012/0193166 | A1 * | 8/2012 | Rogelja | 182/5 |
| 2012/0241700 | A1 * | 9/2012 | Mauthner et al. | 254/391 |
| 2013/0032433 | A1 * | 2/2013 | Codega | 182/5 |
| 2013/0180800 | A1 * | 7/2013 | Mauthner | 182/5 |
| 2013/0313047 | A1 * | 11/2013 | Chaumontet | 182/241 |

* cited by examiner

SAFETY AND DESCENDER DEVICE

CROSS REFERENCE TO RELATED APPLICATION

This Application is a 371 of PCT/1B2012/000044 tiled on Jan. 12, 2012, which claims benefit of the priority of Italian Patent Application No. MI2011A000023 filed on Jan. 13, 2011, both applications are incorporated herein by reference in their entirety.

FIELD OF THE INVENTION

The present invention concerns a belay (of static or dynamic type) and descender (of self-blocking and not) device for adjusting and blocking one or more ropes which are passed through and slide inside the device.

With the term belay device a is intended a safety device, mainly used in the climbing equipment and not, by which a first climber controls and blocks the safety rope used to belay a second anther, or more than one further than allowing the self-belaying for the double or simple rope descent.

BACKGROUND OF THE INVENTION

These devices, known in the mountain climbing field with the term "belay device" or safety device, may be used both in outdoor and indoor climbing, for example in training gyms and they allow to guarantee the safety of one or more climbers in case of emergency, blocking the safety rope/s they are belayed to, thereby avoiding their fall. These devices are usually used to belay a climber (the leader), climbing a face, to a partner on the ground, called in jargon "belayer", which avoids the free fall of the secured climber by means of the belay device, in case of mistake during the climb with the consequent loss of secure grip hold.

This technique is known as "belaying the leader", in which the leader, getting ready to climb, is assisted and belayed, to a partner on the ground, precisely the belayer, by the belay device, which allows in case of emergency the blocking of the safety rope constrained to the climber, the latter having constrained it to one or more rings (returning or belaying points) present on the face as the climb comes along. The belaying of the leader could be carried out by one or more ropes which are passed inside the belay device.

Further, as afore mentioned, other belay devices are known, which take advantage of the possibility of blocking the safety rope in case of emergency, particularly, the belayer may also performs his/her function when he/she is on the face.

For example, the devices may also be used to belay one or more partners having to carry out the ascent, this technique is known as "belaying the follower/s". In these cases a first climber on the face to be climbed acts as belayer and, by means of the, belay device, he/she controls the safety rope to which a second climber, climbing the face under him/her, is belayed. In case wherein the second climber looses the hold, the belay device constrained to the climber on top, or fixed to a hooking point on the face, allows to block the safety rope and then it avoids the partner fall. As said, it is possible to belay two followers too, both constrained to his/her own safety rope which is passed inside the belay device.

Further, in addition to belay the leader and one or more followers, it is known to use these device as descenders (descender devices or rappelling devices), i.e. to descend a previously climbed face. In fact, the climber carrying the device constrained to himself, takes advantage of the belay device able to block the rope sliding in its inside and then to adjust, in case by appropriate means the device is provided with, or simply manually, the descent speed by changing the friction exerted by the device on the rope. Further, following the fall of belayed climber/s, both in case of belaying the leader and one or two followers, the currently available devices allow to unlock the device from the position in which the rope is blocked and to carry out a descent controlled by the climber up to the ground or a secure point on the face.

The belay devices known in the art adjust the rope slide and they block it by applying a braking action, usually producing friction on the safety rope. By doing so it is possible to adjust the slide, to slow down or block the rope slide, thereby avoiding the fall of the climber to be belayed.

Manual or semiautomatic devices are known, the latter snapping automatically in the emergency position in which they block the rope, in case of emergency and then following the sudden tensioning of the rope because of the climber fall.

On the contrary, in manual devices, in case of fall, the person who constrained to himself the device to belay the climbing partner, has to manually displace the safety rope in the position in which the device could slow down the slide and cause the block thereof.

For example, the manual belay device DOBLE V-ROW commercialized by Aludesign SpA company, is provided with a conveniently shaped spout having a housing inside which the rope is forced to pass through in case of climber fall. The particular housing shape allows to apply the friction on the rope, by a blocking karabiner which, following the rope tensioning because of the fall of the belayed climber, allows the friction to be applied on the rope together with the device body, thereby limiting the force applied by the hand the person belaying, the falling partner has to apply to stop the rope.

This type of belay device, even if it is very cheap, guarantees a security and effectiveness level of blocking the rope, depending on the experience and skills of the person using the device, the belayer which belays the partner. Further, also when the rope blocking position is reached, the user must hold firmly the safety rope in his hand avoiding the latter from displacing from the housing which causes the block by friction. Other devices of this type are for example the ATC-GUIDE commercialized by Black Diamond Equipment, and the device REVERSO by PETZL company, which can to be used both as belay device for the leader or one or two followers as the preceding device, being all provided with two throats for the passage of the two ropes, and also as descender devices. Despite this, as afore said, these devices, although they are very cheap, do not guarantee appropriate security levels and they have a number of drawbacks due to their correct positioning and use. Particularly it has to be mentioned that when one or two followers have to be belayed, the device is fixed to a hooking point fixed to the face, usually named "belay point", for example composed of a metallic ring, a karabiner fixed directly to the face or by a rope or similar means. It should be noticed that the correct positioning of the device makes a decisive influence in its operation, in fact, the blocking karabiner, that is what allows to create friction on the rope in case of fall determining its blocking, must be free to move and its displacement should not be limited in any way. In fact, it is necessary that the blocking karabiner is not obstructed by the climber belaying the follower's, or it has to be avoided that the ropes themselves impede and obstruct the movement of the blocking karabiner. This fact does not allow to give rope to the leader without frictions.

Further, the devices now available on the market, both of manual and automatic type, suffer from the problem that to guarantee an effective operation, the person using the device to belay one or more climbers, must hold the rope in a predetermined position and with a lot of strength, under penalty of rope slide.

In fact, both rope ends, entering into and exiting from the device, must be held with a lot of strength and attention in the correct position with respect to the device itself, to avoid problems in reaching the rope blocking position.

To overcome these drawbacks the Applicant made a belay device, commercialized with the name of Click-UP, comprising a main body composed of two plates constrained one to another according two planes preferably parallel by a plurality of constraining means, and an opening in the device body allowing to hook a blocking karabiner in the rope, movable inside the opening itself.

The blocking karabiner allows to constrain the device to the belayer harness.

In case of need, and then in case of all of the belayed climber, the tension the rope constrained to the climber is subject to, determines the displacement of the karabiner inside the opening, of which the device is provided with, from the rope unlocking position, which is the usual use condition, to the emergency (blocking) position in which the rope is blocked between the karabiner and a contrast element.

This device allows to constrain effectively and simply the leader, but also one or two followers simply constraining the blocking karabiner to a hooking point fixed to the face rather than to the belayer harness. When the device is constrained to the fixed hooking point on the face by the blocking karabiner, its operation is substantially for the use of belaying the leader. In fact, the blocking of the rope is obtained by the karabiner displacement inside the opening, of which the device body is provided with, towards the position wherein the rope is blocked between the blocking karabiner and a contrast element.

There are a number of studies carried out to improve and render the afore described device safer and more effective. In particular, the present invention has the object to improve the device use as belay device for one or two followers, that is in case wherein as climber who already reached a certain climb point has to aid one or two partners in the a scent.

In particular, it is an object of the present invention to provide a belay device allowing to improve the belaying and lowering operations of one or two followers. It is further an object of the present invention to provide a device operating in safe and reliable manner independently from the correct device positioning and the freedom of movement of the blocking karabiner.

SUMMARY OF THE INVENTION

The belay device for securing one or more ropes according to the present invention comprises a main body composed of two or more plates constrained one to another according to preferably parallel planes by a plurality of constraining means, composed preferably by spacer pins.

The rope/s is/are inserted inside the body of the device which further comprises a first karabiner hooked to the main body by passing through an opening in the device body.

The first karabiner, when it is hooked in the opening, allows to constrain the device to an user and it is movable in the opening between an unlocking position of the rope, that is the usual use condition, and an emergency position wherein the rope is blocked, and vice versa. The device is characterized by comprising at least one hole (60), obtained on at least one of the plates, adapted to allow the hooking of the first karabiner removed from the opening or of a further (second) karabiner (61) around which the safety rope/s is/are passed and further constraining means (70) of the device to at least one fixed hooking point.

As will be described in detail in what follows, the hole (60) obtained on at least one of the plates for the hooking of a further karabiner (61) allows to carry out the dynamic belaying of one or two climbers, whereas the constraining means (70) to a fixed hooking point are used to allow the recovery or lowering of one or more climbers, To carry out the rope blocking, in ease of fall of one or two belayed climbers, the device comprises at least one contrast element. As after better described, according to some possible operating modes of the belay device, the rope tensioned because of the climber fall presses and blocks the free rope, stopping the climber fall.

As will be more evident in the rest of the description, when the device is used to belay one or two climbers which are the first to carry out the ascent (the leaders), the first karabiner hooked to the opening present in the device allows the constraining thereof to the belayer harness and the rope blocking. In fact, in case of emergency, the tension due to the fall of the belayed climber causes the displacement of the karabiner at the second portion of the opening of the device body, and the rope is blocked by friction between the karabiner and the contrast element.

On the contrary when the device is used to belay one or two followers, i.e. two climbers following other climbers already on the face, preferably it is constrained to a fixed hooking point present on the face through constraining means of which it is provided with. More in detail, the means constraining to a fixed hooking point of the face comprise a through hole inside the device body by means of which a third karabiner, or similar connecting means, are hooked to the device to allow the fixing thereof to a so-called belay (hooking) point present on the face, for example a metallic ring, a rope or a chain constrained to the face to be climbed.

Further, the first karabiner removed from the opening or a further (second) karabiner, or similar means, are hooked to the device body by the hole of which it is provided with. The safety rope/s is/are passed around such a karabiner so that to follow an U-shaped path inside the device body.

Preferably, when one or two followers are belayed by means of a device constrained to a point fixed to the face, the first karabiner hooked into the opening of the device body is removed. The first karabiner removed from the opening may be hooked to the device by means of the hole of which it is provided with or, as mentioned, a further (named second) karabiner is hooked into the device hole.

In fact, the rope blocking, in this use mode, is obtained by the overlapping of the ropes, entering into and exiting from the device, at the area next to the contrast element of which it is provided with.

More in detail, the rope end constrained to the climber, tensioned because of his fall, determines the blocking of the other rope end on the contrast element, of the device. In other words, the free rope end, that is the end not constrained to the climber to be belayed, is blocked by friction between the rope end constrained to the climber, tensioned because of his fall, and the contrast element of the device. Advantageously, such a rope blocking mode allows to increase considerably the device effectiveness and safety.

In addition, according to this use mode, the rope blocking does not need the karabiner constrained to the hole to be movable to allow its correct operation, as it happens nowadays in the belay device currently on the market, for example the Reverso.

BRIEF DESCRIPTION OF THE DRAWINGS

Further characteristics and advantages of the present invention will be more evident in the following description, for illustrative purposes referring to the attached figures, wherein.

DETAILED DESCRIPTION OF THE INVENTION

Figure 1:
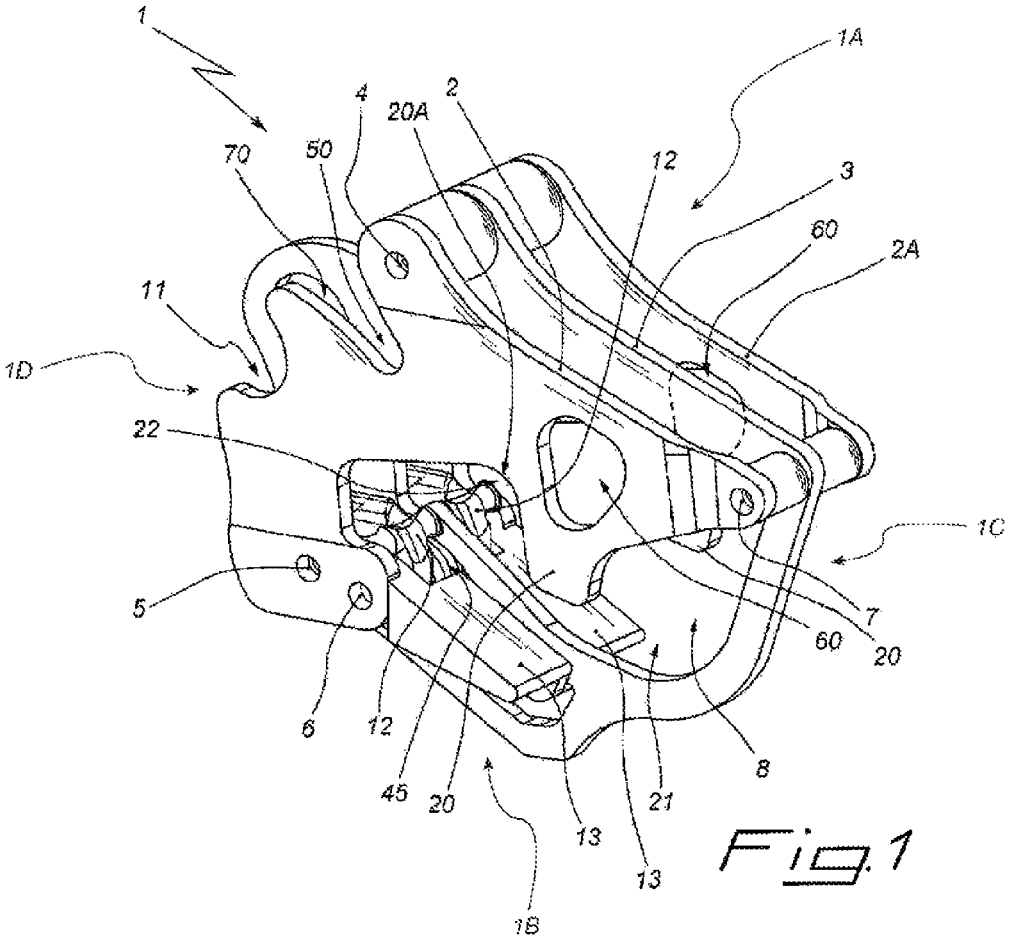
FIG. 1 is a perspective view of the belay device according to the present invention.

The belay (safety) device according to the present invention allows one or more climbers to be belayed by means of one or more corresponding ropes passed inside the device, in fact, the device comprises a main body 1 composed of at least two flat plates 2, 2A and 3 constrained one to another according to substantially parallel planes by a plurality of constraining means 4-7 to create a gap between two facing plates, inside all of which a rope is passed through.

The device further comprises an opening 8 allowing a first karabiner 15 to be hooked in its inside and then to the main body of the device, being movable inside the opening 8 between an unlocking position of the rope/s and a blocking position of the rope/s and vice versa.

As will be more evident in the rest of the present description, particularly referring to FIGS. 2A-2D, the karabiner 15, by means of its movement inside the opening 8, allows to belay one or more climbers (leaders) which are the first to climb a face. In other words, according to a possible device use mode according to the present invention the karabiner 15, movable inside the opening 8, allows to belay the leader by both the use of a single and double rope.

Further, the belay device comprises at least one hole 60 obtained on at least two of the plates 2, 2A and 3, which allow the karabiner 61, or similar means, to be hooked, around which the safety ropes is/are passed, and additional constraining means 70 to allow the device to be fixed to at least one fixed hooking point 80, preferably a fixed point present on the face to be climbed. As will be more evident hereinafter, the karabiner constrained to the device by the hole 60 may be the first karabiner 15 which is removed from the opening 8, or a further karabiner 61 which will be also called second karabiner hereinafter.

As will be described in more detail hereinafter referring to FIGS. 3A-3C, the hole 60 inside which the karabiner 61 is hooked and the constraining means 70, the latter being preferably composed of a further hole 70 obtained on at least two of the device plates, allow to use the device for belaying one or two followers, that is the climbers following the ascent after the at least partial climb of the leader.

As can be seen referring to FIG. 1, in a possible embodiment herein illustrated the belay device comprises a main body 1, composed of three flat plates 2, 2A and 3 constrained one to another by a plurality of constraining means 4-7.

More in detail, the that plates 2, 2A and 3 are made of metallic material with high mechanical features and small weight. As can be seen in the figure, the plates 2 and 2A defining the outer side wall of the device body are made equal one another, whereas the intermediate plate 3 has a structure at least in part different from the others. Despite this, according to further possible structures they can adopt different shape one another, or the plates could be made so that to be identical.

The three plates 2, 2A and 3 are constrained one another so that to form two gaps (spaces) between each couple of them. Each gap between two facing plates allows, preferably, the passage of a safety rope 10.

It has to be noticed here and hereinafter that it will be referred to the embodiment wherein the device is provided with three plates adapted to form two gaps substantially equal one another for the passage of a rope in each of them. Despite this, it is possible to realize a belay device according to the present invention provided with two flat plates constrained so that to be faced one another to font, a gap for the passage of only one rope. Obviously, it is possible as well to provide the device with further plates, or to place side by side and constrain one another several devices so that to be able to use more than two ropes to belay one or more climbers. In fact, also if in the present description it is and it will be referred to the belaying of one or two leaders or followers, the device according to the present invention may be conveniently modified to use more than two ropes to belay more than two climbers too.

In the embodiment shown in the figures, the plates 2, 2A and 3 are constrained in a facing and corresponding position, i.e. so that to establish three planes preferably parallel, by four spacer pins 4-7 made of metallic material too.

As can be seen in FIG. 1, showing a perspective view of the belay device according to the present invention, the device body is provided with an opening 8 structured so that to define a specific shape, through which the device reaches a first unlocking position of the rope's, wherein the latter is free to slide, and a second blocking position of the rope/s, or emergency position.

The shape of the opening 8 on each of the three plates 2, 2A and 3, is provided with a protruding area, or at least one protruding element, composed preferably of a protruding teeth 20, dividing the opening in two subsequent portions 21 and 22, the first portion 21 beneath the teeth 20, and the second portion 22 above the teeth 20. As shown in figures, the protruding teeth 20 protrudes inside the opening 8, dividing substantially the latter in two portions, or areas 21 and 22, wherein the karabiner 15 may be disposed, it has to be noticed that in the embodiment illustrated in attached figures the protruding teeth 20 is realized only at the outer plates 2 and 2A, despite this it is possible to realize a teeth correspondingly on each plate the device is provided with. In general, for each gap inside which a rope 10 could be inserted between two plates joined one another, it is necessary to provide for at least one protruding tooth 20 on the profile of the opening, 8 next to at least one of the two plates determining the gap formation.

In addition, the hole 60 for hooking the karabiner 61, or a similar connector, is obtained in the illustrated embodiment in figures at each outer plate 2 and 2A. Obviously it is possible to realize a hole 60 also on the intermediate plate 3 so that it is disposed correspondingly to those realized on the other plates of the device, it has to be observed as well that the hole shape can obviously change according to building needs, particularly according to an embodiment the hole shape is circular, however it is possible to realize holes with oval shape too, or non-perfectly circular.

In general, the hole dimensions allow to hook the karabiner in its inside. It has to be noticed as well that the tilt of one of the hole sides has to place the karabiner in the most favorable position to allow the triangle of forces to block the rope/s, further to allow the unlocking of the rope/s without excessive efforts, such as it happens in the known devices, particularly during the steps of belaying the followers.

Preferably, the hole 60 to allow the karabiner 61 to be hooked, around which the rope/s 10 inserted inside the device is/are passed, is disposed in correspondence of the protruding element of the profile of the opening 8, that is at the tooth 20.

As afore said, the karabiner constrained to the device by the hole 60 may be the first karabiner 15 which is removed from the opening 8, or a second karabiner 61.

In addition, as afore said, the device comprises additional constraining means 70 allowing the hooking to a fixed point 80, preferably a rope, a chain, or a metallic ring, present on the face. Preferably these means comprise a hole 70 obtained on at least one plate of the device body. In the embodiment illustrated in the attached figures, the hole 70 is obtained only on the intermediate plate 3.

Obviously, also the hole 70 may be obtained correspondingly on some or all plates the device is provided with, and the hole shape may change according to the needs. Preferably the hole 70 obtained on one or more plates of the device allows the karabiner 71 (hereinafter called for clarity third karabiner), or other similar connectors, to be hooked to allow the connection simply and at the same time effectively with the fixed hooking point 80 on the face, in jargon named belay point.

The plates 2, 2A and 3, constrained one another, define the body 1 of the device which is partially closed along the side surface by a covering portion preferably made of plastic material, not: shown in attached figures and conveniently shaped to be accommodated at the side surface of the device body so that to cover the space between the plates.

As can be seen in FIG. 1, the portion 11 of side surface of the device is open, to allow the safety ropes 10 to be inserted inside the device body in the two spaces between the plates 2-3 and 2A-3.

The insertion operations of the ropes 10 inside the device provide that each safety rope is folded substantially as "U", for the insertion through the open portion 11 of the outer side surface of the device body, up to reach the lower part thereof.

Each rope 10 must be inserted correctly inside the device, so that the end 10*a*, that is the cad passing next to the pin 4, is constrained to the climber to be belayed, whereas the end 10*b*, passing next to the pins 5 and 6, corresponds to the free end of the rope which slides inside the device as the climber goes up on the face.

The correct operation of the belay device according to the present invention provides for the use of a blocking karabiner 15, or an equivalent connector, which is hooked to the device after the safety rope/s is/are inserted.

Figure 2A:
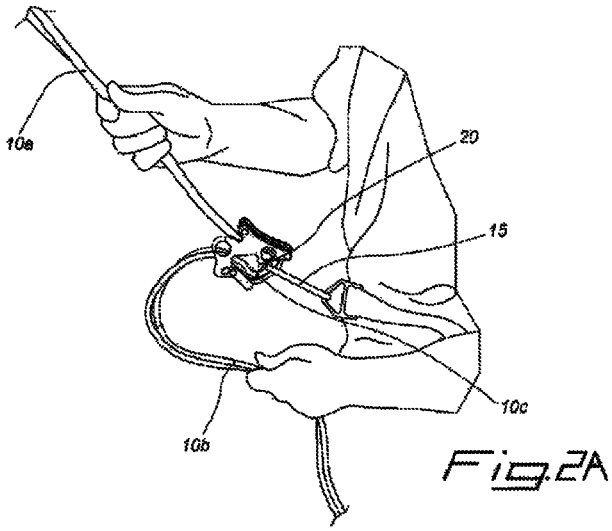
FIG. 2A shows a belay device according to the present invention used to belay one or two leaders in the unlocking position of the safety rope/s.

As shown in particular in FIG. 2A, the blocking karabiner 15 of the conventional type is hooked to the body 1 of the device by passing the open karabiner through the openings 8 of the device body, so that it is hooked to each of the three plates 2, 2A and 3.

When the device is used to belay the leader, both in single and double rope, the blocking karabiner 15 performs the double function of constraining the device to the user (the belayer) which belays the leader in case of fall, in addition to cooperate with the same device, to carry out the rope blocking.

In other words, there is no need for additional karabiners, or equivalent means, to constrain the device according to the present invention to the user belaying the partner.

As will be more evident hereinafter referring to the device operation description, the blocking karabiner 15 hooked to the device through the passage in the opening 8 is movable inside the opening itself between the first portion 21 and the second portion 22, and vice versa. When the karabiner is in the first portion 21 of the opening 8, a position shown in FIG. 2A, the device is in a position blocking the rope, i.e. in the position of normal use in which the repels is/are free to slide inside the body 2 of the device.

Figure 2B:
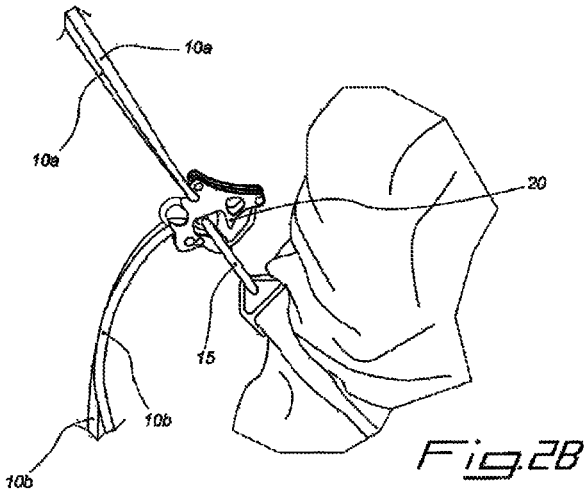
FIG. 2B shows a belay device according to the present invention used to belay one or two leaders in the blocking position of the safety rope/s.

When the blocking karabiner 15 is at the second portion 22 of the opening 8, a position illustrated in FIG. 2B, the device is in emergency position, and the rope/s 10 is/are blocked so that the movement thereof is prevented.

The belay device is of the semiautomatic type not only if the user holds the loose rope in his/her hand, that is the "free" end of the rope 10*b*. In case of fall of the belayed climber, the user (belayer) holds the free end of the rope in the hand and the blocking karabiner 15 snaps into the blocking position automatically. In fact, because of the fall, the "occupied" end of the rope 10*a* is subjected to a tension applying a three on the karabiner causing the displacement thereof along the opening 8 from the first portion 21 to the second portion 22, in which the device is in emergency position and the further slide of the rope is inhibited.

Inside the body 1 of the belay device that is inside the spaces defined by the plates 2, 2A and 3, a contrast element 12 and means to prevent the fortuitous displacement of the blocking karabiner 15 from the unlocking position of the ropes to the emergency position, and vice versa, are disposed. Hereinafter the contrast element 12 and the means 13 to prevent the fortuitous displacement of the blocking karabiner 15 are described referring to only one space between the two plates, however it is evident that in devices provided with more spaces for the rope passage between two plates the same elements are usually installed.

The contrast element 12 is fixedly constrained, at the pins 5 and 6 and it is the element determining the rope blocking. More in detail, during the use to belay one or more leaders, the contrast element 12 collaborating with the karabiner 15 allows the rope blocking. In fact, the karabiner 15 is disposed. In the second portion 22 of the opening 8 after the rope tensioning due to the fall of the belayed climber and because the user (belayer) held, or not, the free end 10*b* of the rope. On the contrary, as will be described more in detail hereinafter, when the device is used to belay one or two followers, the occupied end 10*a* of the rope, tensioned after the all of the belayed climber, causes the blocking of the free end 10*a* of the rope, cooperating with the contrast element 12. More in detail, the free end of the rope 10*a* is blocked between the occupied end 10*b* of the rope and the contrast element 12. In other words, the relative slide of the ends 10*a* and 10*b* of the security rope/s is prevented.

As can be seen in FIG. 1, the contrast element 12 is provided, on its own surface contacting the rope, with a V-shaped throat 45, or equivalent means, to improve the generated friction on the rope so that to render the blocking more effective.

As can be seen particularly referring to FIG. 2B, when the device is in the portion blocking the rope 10, the latter is tightened between the contrast element 12 and the karabiner 15 disposed in the second portion 22 of the opening 8. The slide of the rope 10 is blocked because of the friction generated by the karabiner 15, which is forced against the contrast element 12 under the tension effect of the rope 10.

The means for preventing the fortuitous (undesired) displacement of the karabiner 15 include the movable lever 13 rotatably constrained to the end part of the contrast element 12. More in detail, the lever is constrained to the contrast element 12 by means of a spring, not shown in figures.

The spring is loaded so that to three the movable lever 13 to arrange in an opposed position with respect to the tooth 20 of the opening 8.

In other words, the preloading of the spring determines the rotation of the lever 13 so that it is disposed towards the central part of the device.

The lever prevents the displacement of the karabiner 15 from the first portion 21 to the second portion 22 of the opening 8 and vice versa, acting on the rope only, and on the karabiner.

As a matter of fact, when the device is in the unlocking position of the rope 10 and the karabiner 15 is in the first portion 21 of the opening 8 (the position shown in FIG. 2A), the movable lever 13 pushes, because of the preloading of the spring, onto the portion of the rope 10*c* and then onto the karabiner 15 so that the latter stays beneath the tooth 20, avoiding the displacement thereof along the opening 8.

Doing so, the person carrying the device constrained to himself could let the rope slide freely inside the device without running the risk the karabiner 15 might move accidentally in the second portion 22, thereby determining the undesired reaching of the blocking position of the rope.

The spring preloading is such that in normal use conditions the fortuitous displacement of the karabiner 15 is prevented.

In emergency conditions, the force exercised by the tensioned rope 10 on the karabiner 15 is able to overcome the contrast offered by the spring preloading, displacing the movable lever 13 to allow the movement of the karabiner 15 along the opening 8 up to reach the blocking position of the rope in the second portion 22 (FIG. 2B).

Figure 2C:
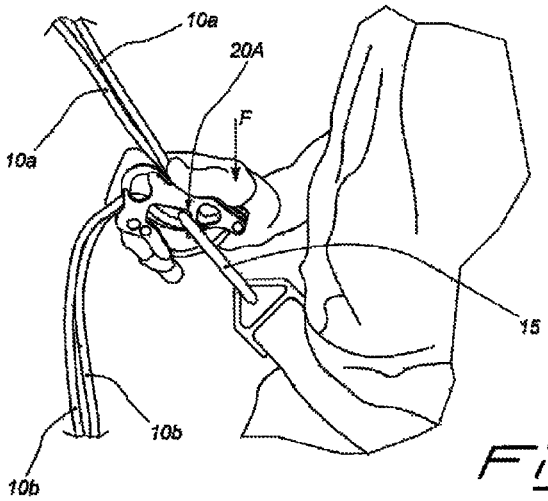
FIG. 2C shows a belay device according to the present invention used to belay one or two leaders during the lowering of the belayed climber and then in the slide controlled position of the safety rope/s.
Figure 2D:
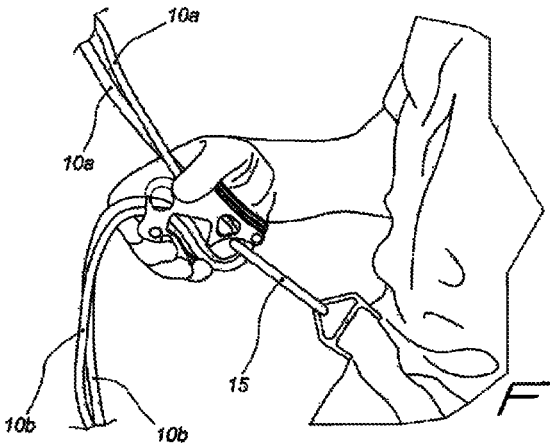
FIG. 2D shows a belay device according to the present invention used to belay one or two leaders which is brought back in the unlocking position of the safety rope/s.

When the karabiner reached the second portion 22 to determine the blocking of the rope 10, the movable lever 13 is free to come back into the position wherein it is opposed to the tooth 20 of the opening 8. For this reason, when it is necessary to bring back the device into the blocking position of the rope, the user will have to manually displace the device body so that to move the karabiner 15 along the opening 8 from the first portion 21 to the second portion 22, as it is illustrated in FIG. 2C.

To carry out such an operation, a force will have to be exercised so that to overcome the spring preloading of the movable lever, so that to determine the temporary displacement of the latter and to allow the passage of the karabiner 15 next to the tooth 20. Once the karabiner 15 has been brought back into the first portion 21 in the unlocking position of the rope, the lever comes back into the position in which it is opposed to the tooth 20 to avoid the fortuitous displacement of the karabiner into the blocking position, during a new use step. (see FIG. 2D)

As before described, the rope 10 must be inserted correctly inside the device. In case in which the rope is inserted unintentionally in a wrong way, that is to say with the end 10*b*, passing at the pins 5 and 6, constrained to the climber to be belayed, and with the end 10*a* free, the belay device according to the present invention is anyway able to guarantee the blocking of the rope and to avoid the belayed climber fall.

In fact, as it can be seen in the appended figures, the upper part of the plates 2 and 2A and 3, next to the pin 4, is shaped so that to comprise a throat 50 on each of them to guarantee the blocking of the rope in case the latter has been inserted incorrectly inside the device.

In case of fall of the belayed climber the end 10*b* constrained erroneously thereto is tensioned, but the device, being used in a wrong way, does not snap into the emergency position, or any way it is not able to exercise such a friction to allow the rope blocking.

The free end 10*a* of the rope, under the tension effect due to the weight of the falling climber, tends to arrange independently, or any way it is forced by the user belaying the partner to pass inside the throats 50 which allow the friction to be exercised on the rope, determining the blocking thereof. The throats 50 are conveniently shaped so that to ease the arrangement of the end 10*a* of the rope/s in their inside and exercise a sufficient friction to determine the blocking thereof.

However it has to be specified that the throats 50 assure the rope blocking in an incorrect use condition of the device, which has not to be preferred to that illustrated in figures, wherein the end 10*a* of the rope, passing at the pin 4, is the end constrained to the climber to be belayed.

The operation steps of the belay device will be described, for purposes of illustration, according to the present invention, in case wherein it is used to belay the leader. As afore mentioned, this technique provides that a person on the ground, or on the face, having the device constrained to himself by the karabiner 15, belays the leader climbing the face.

First of all, the person on the ground must insert the rope/s 10 inside the device and hook the karabiner 15 passing it through the opening 8. It has to be noticed that in FIGS. 2A-2D the device use with two ropes 10 in its inside is shown, each rope being provided with one occupied own end 10*a* and one free end 10*b*.

Subsequently, the person on the ground constrains the device, in the unlocking position of the rope, to himself by hooking the karabiner 15 to his harness, or to a specific belt, usually used in the climb equipment.

The task of the person on the ground is to slide the safety rope/s inside the device as the climber moves along the ascent, that is to slide the free end 10*b* inside the device, to render it available for the climber which is constrained to the end 10*a*.

The person on the ground renders the rope available for the climber, using a well known technique, consisting in avoiding holding the belay device in the hand, and using the hands to control the rope portion upstream and downstream of the device, respectively, i.e. the free end 10*b* and the occupied end 10*a* of the belayed climber.

In case of emergency, that is of fall of the belayed climber, the person on the ground holds the loose rope, that is the free end of the rope 10*b*, and the device moves automatically into the blocking position of the rope, by the displacement of the karabiner 15 along the opening 8, because of the force given by the tensioned rope on the karabiner itself. (FIG. 2B)

In fact, in the moment wherein the climber looses the hold and then starts filling, the occupied end 10*a* of the rope is tensioned due to the climber weight. Such a sudden tension increase of the occupied end causes the displacement of the karabiner 15 along the opening 8, under the effect of the three given by the rope which would tend to come out from the device.

The force given by the tensioned rope is such to overcome the countering force of the spring of the movable lever 13, allowing the passing of the karabiner 15 in the second portion 22, i.e. In the blocking position of the rope. In particular, the rope is tightened between the contrast element 12 and the karabiner 15.

Doing so, the rope/s is/are substantially blocked by friction between the contrast element 12 and the karabiner 15.

In the emergency position, to unlock partially the rope, it proceeds reducing the friction between the karabiner 15 and the contrast element 12. To carry out such an operation, the user acts manually on the device, displacing the body 1 as illustrated by the arrow F in FIG. 2C. The user may act directly on the device body or, according to a possible embodiment, on a lever 30 constrained to the device, as it will be described referring to the embodiment illustrated in FIGS. 4A and 4B.

To reduce the friction on the rope/s when the device is in the blocking position, and then to control the slide thereof, it is sufficient to displace manually the device body, substantially in the direction indicated by the arrow F, or any way in such a way to limit the friction produced on the rope disposed between the contrast element 12 and the karabiner 15. By pushing manually, the device body rotation is substantially determined towards the free end of the rope 10*b* (FIG. 2C), causing the decrease of friction applied on the rope by the contrast element 12 and the karabiner 15.

The controlled slide of the rope, when the device is in the blocking position, is used for example when it is intended to give rope to the fallen climber which has subsequently recovered the hold, or if the device is used as a descender.

The manual action of the user on the device body, in fact, causes the displacement of the contrast element 12, constrained thereto, with respect to the karabiner 15, which is substantially still because it is subjected to the rope tension. It follows that the rotation of the contrast clement 12 with respect to the karabiner 15 changes the friction exercised on the rope, causing the slide thereof.

According to the device body displacement carried out by the user, it is possible to have a more or less evident controlled slide of the rope.

Figure 4A:
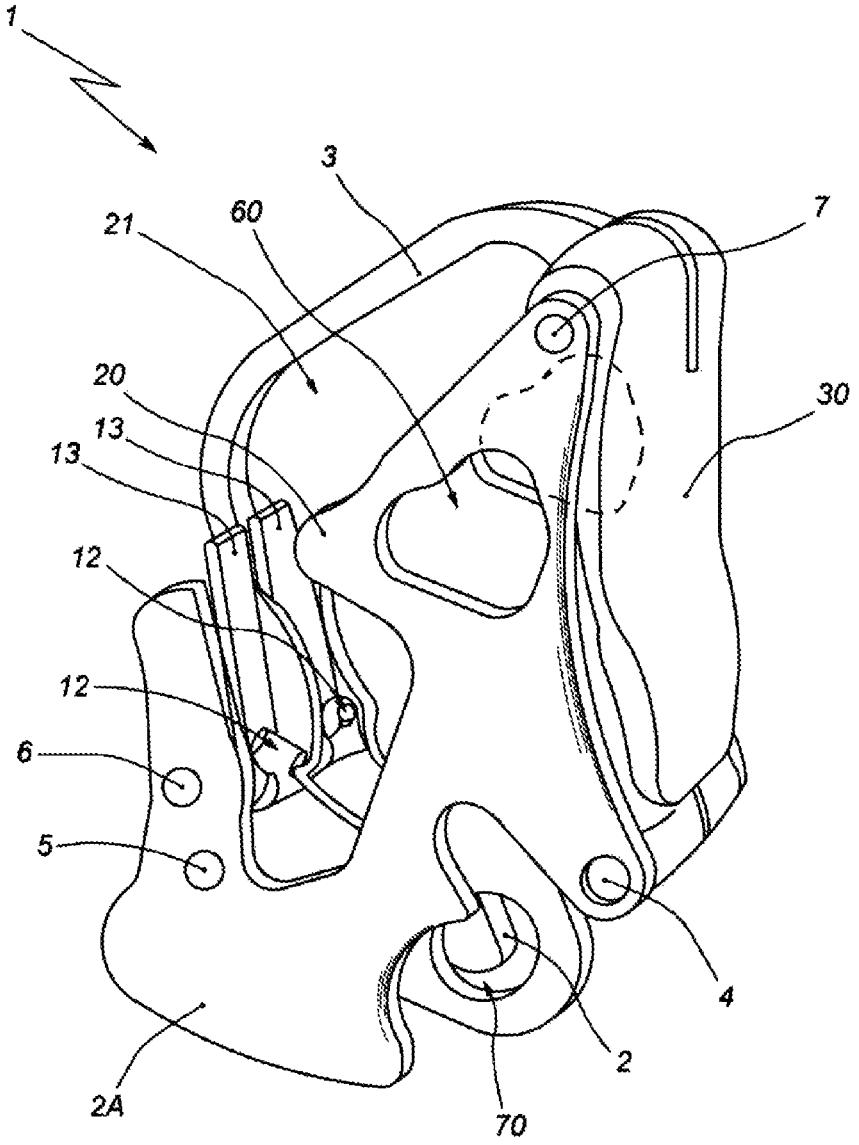
FIGS. 4A and 4B show the belay device according to the present invention provided with a lever facilitating the controlled slide of the safety rope/s.
Figure 4B:
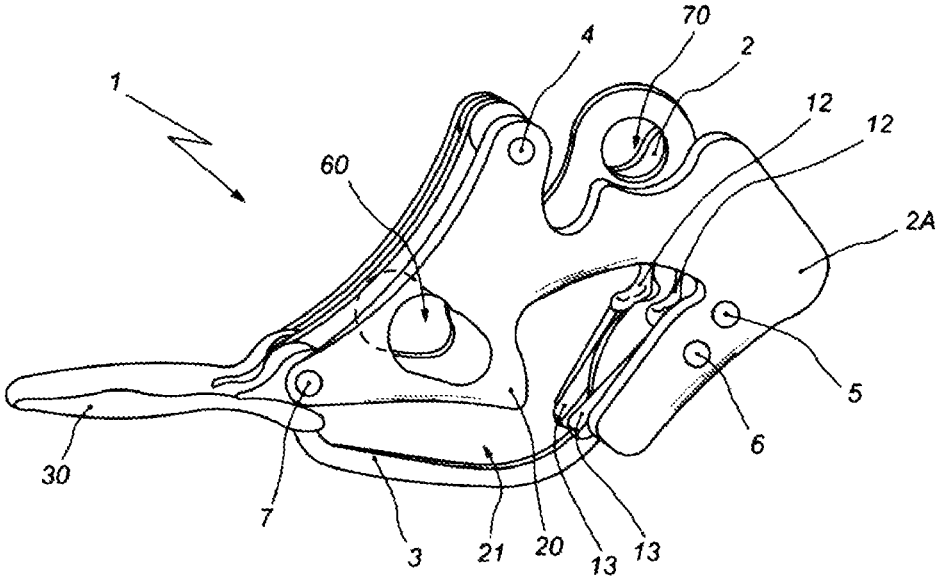

According to a possible embodiment of the device according to the present invention illustrated in FIGS. 4A and 4B, it comprises a lever 30 to ease the device rotation to obtain the controlled slide of the safety rope/s.

More in detail, a lever 30 is rotatably constrained to the body 1 of the device, and particularly it can be rotated around the pin 7 constraining the plates 2, 2A and 3.

The lever 30 can be rotated between a rest position in which it is placed sideways the device body so that to not interfere during the use (FIG. 4A), and an operative position (FIG. 4B), in which the lever 30 protrudes with respect to the device body so that the user could act easily on it.

Advantageously, a spring not shown in figures, or similar means, allow to maintain the lever 30 in the rest position of FIG. 4A.

The lever 30 is constrained to the body 1 of the device so that it could be rotated with respect to the latter between the rest position and the operative position, in fact, once such a position (FIG. 4B) is reached, the additional lever rotation is prevented. Doing so the user could exercise a force on the body 1 of the device by the lever 30, the force allowing to obtain the controlled slide of the safety rope/s similarly to what previously described.

In fact, to unlock partially the rope and determine the controlled slide thereof, the user moves the lever 30 from the rest position up to the operative position in which the force given to the lever 30 is transmitted to the body 1 of the device which rotates leading to the friction decrease between the karabiner 15 and the contrast element 12.

Obviously, although it has been explicitly referred to the adjustment of the controlled slide of the rope during the leader belaying, it has to be noticed that the lever 30 may be used in other device use modes according to the present invention, such as for example the climb in "Top Rope" mode and the descent in double rope.

It has to be noticed as well that in the blocking position of the rope/s, as can be seen in FIG. 2C, it is possible to give rope holding the karabiner 15 at the corner 20A of the opening 8. In such a position the device must be held by the user so that to not be directed towards the first return, in case of fall of the belayed climber/s, the user leaves the karabiner 15, which snaps into the blocking position because of the tension of the rope/s, as afore described.

In addition, in the blocking position of the rope/s, by the device according to the present invention, it is possible to carry out the automatic belaying along the climb in "Top Rode" mode, also said "Moulinette".

As afore said, the device according to the present invention is further provided with at least one hole 60 passing through the body of the device itself, allowing a karabiner 61 to be hooked, around which the rope inserted inside the device is passed and means constraining to a fixed hooking point, which preferably comprise a further hole 70.

As afore said, the karabiner constrained to the device by the hole 60 may be the first karabiner 15 which is removed from the opening 8, or a second karabiner 61.

It has to be mentioned that with the term hole "passing through the device body" it is intended that the holes are at least in part passing through at least one of the plates of the device body so that to allow the device itself to be fixed to a karabiner, or similar connecting means, such as for example metallic rings and so on.

As afore said, obviously the holes may be disposed correspondingly on each plate of the device, so that to allow karabiner or similar means to pass through the whole device.

However, in other possible embodiments, the holes are obtained on only one plate, preferably the central plate 3 or only on the outer plates 2 and 2A.

The holes, of which the device according to the present inventions is provided with, are used in some use steps of the device, in particular while one or two followers are belayed.

Preferably, one or more karabiners 61 and 71 are hooked to the corresponding holes 60 and 70, only in case in which the device is used to belay one or two followers.

In fact, when the device is used to belay the leader, as afore described, the hole 60 is not used to constrain karabiners to the device, and the blocking karabiner 15 only is constrained to the device body by the passage in the opening 8 thereof.

Further, also the means 70 constraining to a fixed hooking point, usually are not used and the third karabiner 71, or similar connecting means, are not hooked to the device body, because the only blocking karabiner 15 hooked to the opening 8 of the device allows the correct operation of the latter and the blocking of the safety rope/s of one or two followers.

On the contrary when the device is used to constrain one or two followers, preferably the blocking karabiner 15 is not installed inside the opening 8 of the device and two karabiners 61 and 71 are hooked respectively into the holes 60 and 71 of which it is provided with.

It has to be considered greatly that by the Click Up device commercialized by the Applicant, the belaying function of the followers may be carried out by the blocking karabiner 15 only, which is connected to the fixed hooking point on the face.

It has to be noticed that, according to a possible operating mode of the present device, it is possible to belay "dynamically" one or two climbers by using only one karabiner 61 hooked inside the hole 60 and passing the ropes 10 around the karabiner 61.

On the contrary, when the device is used to belay one or two followers by using the holes 60 and 70 of which it is provided with, the first blocking karabiner 15 is removed from the opening and two karabiners 61 and 71 (a second and a third karabiner) are installed inside the hole 60 and 70.

Obviously, when the belaying mode for the leader has to be modified to the belaying mode for the followers, the same karabiner (first karabiner 15) previously hooked to the opening 8 may be removed and hooked to the hole 60.

As will be evident at this point of the description, not being installed any more the blocking karabiner 15, the rope will not be blocked in case of emergency, i.e. In case of fall of one of the climbers, by its slide from the first to the second portion of the opening 8, as afore described referring to FIGS. 2A-2D.

In fact, according to this possible use mode, two karabiners 61 and 71, or similar means, are constrained to the device at the two holes 60 and 70. The karabiner 71 constrained to the hole 70 allows to fix the belay device to a belay (hooking) point 80 provided on the face.

Figure 3A:
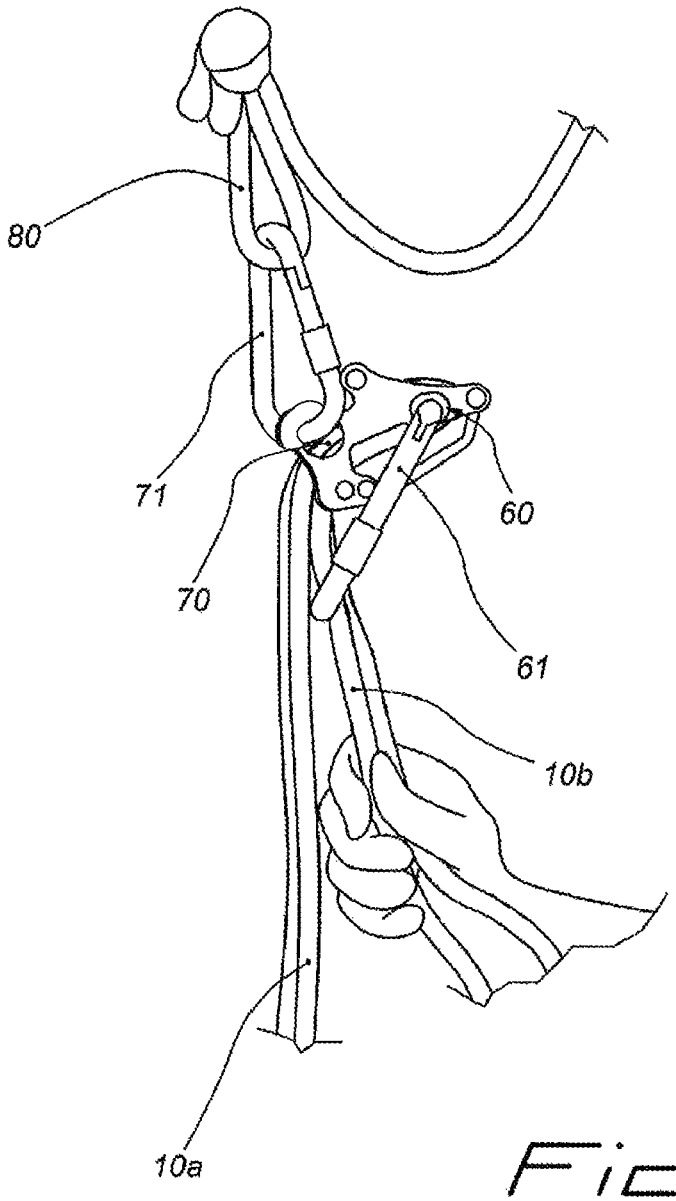
FIG. 3A shows a belay device according to the present invention used to belay one or two followers in the unlocking position of the safety rope/s.
Figure 3B:
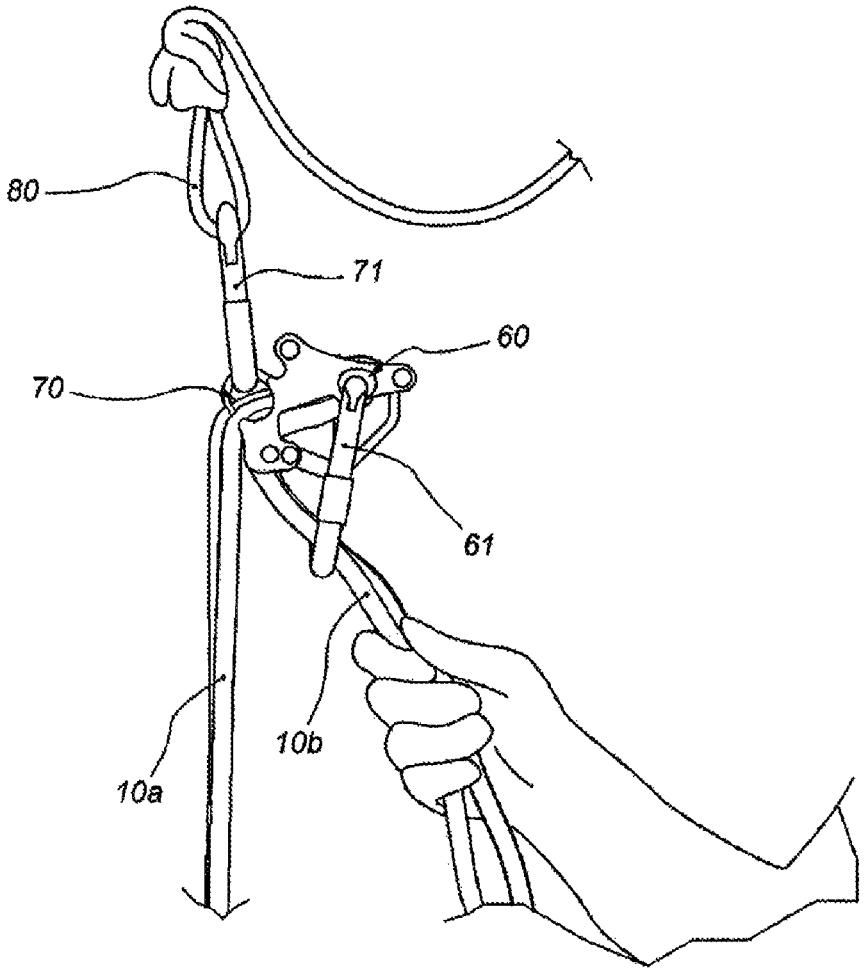
FIG. 3B shows a belay device according to the present invention used to belay one or two followers in the blocking position of the safety rope/s.
Figure 3C:
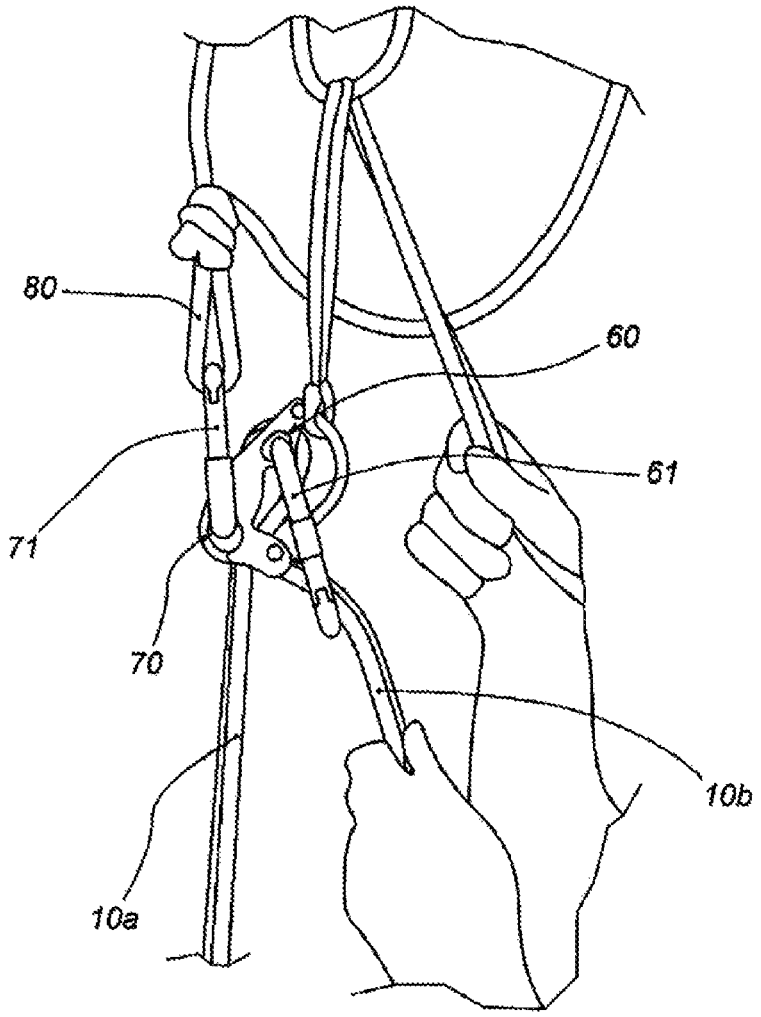
FIG. 3C shows a belay device according to the present invention used to belay one or two followers during the lowering of the belayed climber and then in the slide controlled position of the safety rope/s.

The safety rope/s 10 is/are inserted inside the device so that to pass around the karabiner 61 constrained to the hole 60, and so that the two ends 10*a* and 10*b* would pass at the area next to the contrast element 12, as shown in FIGS. 3A-3C.

In fact, the blocking of the rope 10, in case of use with the two karabiners 61 and 71, is determined as a consequence of the tensioning of the end 10*a* constrained to one of the two climbers to be belayed, which causes the device rotation around a constraining point with the face, that is to say substantially at the hole 70 in which the fixing karabiner 71 is constrained to the belay point 80.

Doing so the two ends 10*a* and 10*b* of each rope entering in and exiting from the device will be in a position in which they are superimposed and they cannot slide one with respect to the other. More in detail, the occupied end 10*a* of the rope, after its tensioning due to the climber fall, overlaps to the free end 10*b* of the rope itself determining the compression thereof at the contrast element 12.

As afore said, such a device operation is obtained by a specific position of the holes 60 and 70 on the device body which determines the formation of such a triangle of forces to cause the blocking of the rope/s, in addition to allow their unlocking without the need of excessive efforts.

The operation steps of the belay device will be described, for purposes of illustration, according to the present invention, in case wherein it is used to belay one or two climbers. As afore mentioned, this technique provides that a climber, usually the leader, has already completed part of the ascent and reached a height point on the face. At this point the leader belays one or two climbers which are going to come up the face antecedently climbed by the leader.

By the device according to the present invention illustrated in FIGS. 3A-3C, the leader may belay one or two followers, by passing a rope for each climber to be belayed inside the device. To belay the followers, first of all the person on the face constrains the device to a fixed hooking point 30, in jargon named belay point, or similar, present on the face to be climbed, for example composed of ropes, metallic chains, or rings.

The device connection to the fixed hooking point 80 of the face occurs by the karabiner 71 hooked inside the hole 70 passing inside the device body.

Subsequently the person on the face proceeds to insert the rope/s 10 of the follower/s to be belayed, each one inside one space between two device plates. The rope/s is/are passed inside the device forming a "U" around the karabiner 61 which is inserted into the hole 60.

As shown in FIG. 3A, the task of the person on the face is to slide the safety rope inside the device as the followers move along the ascent, that is to slide the free end 10*b* of the rope (or ropes) inside the device, to render it available for the climber which is constrained to the end 10*a*.

In case of emergency, that is in case of fall of the belayed climber, the weight of the falling climber will tension the end of the rope 10*a*.

In other words, in the moment wherein the climber looses the hold and then starts falling, the occupied end 10*a* of the rope is tensioned due to the climber weight. Such a sudden increase of the occupied end 10*a* causes the device rotation around the constraining point with the face, that is at the hole 70 in which the karabiner 71 is constrained under the effect of the force given by the rope 10 which would tend to go out from the device but which is retained because of the passage around the karabiner 61 hooked to the hole 60 of the device.

As can be seen in FIG. 3B, at the contrast element 12, the two ends 10*a* and 10*b* of the rope are in a superimposed position with the tensioned occupied end 10*a*, which "presses" the free end 10*b* on the contrast element 12. Doing so the rope is substantially blocked by friction, not being possible the relative slide between the two ends 10*a* and 10*b* of the rope.

In the emergency position, to unlock partially the rope, it proceeds reducing the friction acting between two rope ends and the contrast element.

In other words, the pressure applied from the end 10*a* of the tensioned rope on the free end 10*b* is reduced by the device rotation around the portion which allows the constrain thereof with the fixed hooking point 80, that is to say in correspondence of the hole 70.

The device rotation is determined manually by the climber on the face which belays the followers. In fact, he/she operates manually, acting directly on the device body, or by a string, or similar means, constrained to the body itself, as shown in FIG. 3C.

Alternatively, the user could act on the lever 30 constrained to the body 1 of the device, in the same way to what previously described referring to FIGS. 4A and 4B.

The invention claimed is:

1. Belay device comprising:

a main body having a top, a bottom, a first end and an oppositely disposed second end, said first end and said second end intermediate said top and said bottom of said main body, said main body composed of a first plate, a second plate and a third plate constrained one to another according to substantially parallel planes by a plurality of constraining means, said third plate being positioned intermediate said first plate and said second plate, said first, second and third plates being spaced from each other to provide a first gap between said first plate and said third plate and to provide a second gap between said second plate and said third plate for a rope to be inserted into said first gap present between said first plate and said third plate or for a rope to be inserted into said second gap between said second plate and said third plate, wherein said first, second and third plates proximal to said first end are adapted to provide said main body with an opening for hooking a first karabiner to said main body of the device by passing through said opening, said opening being divided between a first portion corresponding to an unlocking position of said one rope and a second portion corresponding to a blocking position of said one rope, wherein said first karabiner constrains said device to a user when said first karabiner is hooked into said opening, wherein said first plate and said second plate each have a protruding tooth in alignment with each other, each of said protruding tooth projecting into and separating said opening into said first portion and said second portion, wherein said main body further includes a first through hole disposed in one of said plates at a position proximal to said first end adapted to allow the hooking of said first karabiner removed from said opening or of a second karabiner around which said rope is passed through, said first through hole being positioned intermediate said top of said main body and said protruding tooth of said first plate, and wherein said main body further includes a constraining hole disposed in said one of said plates at a position proximal to said second end.

2. The device according to the claim 1, further comprising a second through hole disposed in a different one of said plates to allow hooking of a third karabiner.

3. The device according to claim 2, wherein said first through hole is disposed in said first plate and said second through hole is disposed in said second plate.

4. The device according to claim 3, wherein said second through hole is disposed in said second plate at a position intermediate said top of said main body and said protruding tooth of said second plate.

5. The device according to claim 1, wherein said main body further includes a contrast element for blocking said rope, said contrast element being disposed in said first gap present between said first plate and said third plate and said second gap present between said second plate and said third plate, said contrast element being further disposed proximal to said bottom and said second end of said main body.

6. The device according to claim 1, wherein when said second karabiner is hooked to said first through hole of said device, said first karabiner movable inside said opening can be removed from said opening.

7. The device according to claim 1, further including a movable lever inside said opening at a position proximal to said bottom of said main body, said movable lever being disposed in said first gap present between said first plate and said third plate or disposed in said second gap present between said second plate and said third plate, said movable lever being biased towards said top of said main body to inhibit accidental displacement of said first karabiner from said first portion of said opening to said second portion of said opening.

8. The device according to claim 7, wherein said movable lever is disposed in an opposed position to said protruding tooth of said opening.

9. The device according to claim 1, wherein each of said first, second and third plates further include a groove at a position intermediate said top and said second hole.

10. The device according to claim 1, wherein said constraining hole is disposed in said third plate.

* * * * *